US006310528B1

(12) United States Patent
Kuboyama et al.

(10) Patent No.: US 6,310,528 B1
(45) Date of Patent: Oct. 30, 2001

(54) OVERCURRENT-TRIPPING DEVICE FOR CIRCUIT BREAKER

(75) Inventors: Katsunori Kuboyama; Naoshi Uchida; Isamu Nagahiro, all of Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 09/573,334

(22) Filed: May 18, 2000

(30) Foreign Application Priority Data

May 25, 1999 (JP) ..... 11-144436

(51) Int. Cl.[7] ..... H01H 67/02
(52) U.S. Cl. ..... 335/132; 335/202
(58) Field of Search ..... 335/250–252, 335/129, 126, 131

(56) References Cited

U.S. PATENT DOCUMENTS 4,025,887 * 5/1977 Romans ..... 335/578
5,218,332 * 6/1993 Blanchard et al. ..... 335/132
5,233,321 * 8/1993 Blanchard et al. ..... 335/132
6,084,488 * 7/2000 Macbeth et al. ..... 335/132

* cited by examiner

*Primary Examiner*—Lincoln Donovan
(74) *Attorney, Agent, or Firm*—Kaneska & Takeuchi

(57) ABSTRACT

In an overcurrent-tripping device for a circuit breaker, an electromagnet is used to open a movable contact shoe when a heavy current flows through a conduction path. A push rod is provided so as to contact the movable contact shoe. The electromagnet of the overcurrent-tripping device is located above the push rod so as to attract a movable iron core of the overcurrent-tripping device linearly along a moving direction of the push rod. When the heavy current such as a short-circuit current flows through the conduction path, the movable iron core is attracted to push the movable contact shoe via the push rod for rapid opening of the movable contact shoe. Thus, before a tripping operation of the opening-and-closing mechanism, the movable contact shoe is moved, so that the time required by the movable contact shoe for the opening operation is reduced.

6 Claims, 7 Drawing Sheets

OVERCURRENT-TRIPPING DEVICE FOR CIRCUIT BREAKER

BACKGROUND OF THE INVENTION AND RELATED ART STATEMENT

The present invention relates to a circuit breaker having an overcurrent-tripping device for detecting a short-circuit current to allow an opening-and-closing mechanism to perform a tripping operation, and opening a movable contact shoe before opening the same by the tripping operation of the opening-and-closing mechanism.

FIG. 7 is a vertical sectional view of a conventional circuit breaker of the above design in an ON state. In FIG. 7, a molded case 1 has conduction paths therein, each being formed of a pair of opposed fixed contact shoes 2 and 3, and a movable contact shoe 4 bridging the fixed contact shoes 2 and 3, with a power supply side terminal 5 integrally formed at an end of the fixed contact shoe 2. The movable contact shoe 4 is held in a movable contact shoe holder 6 formed of an insulating material so that the movable contact shoe 4 can move linearly in a vertical direction of FIG. 7, and the movable contact shoe holder 6 is guided in the molded case 1 to enable linear movement. The movable contact shoe 4 is pressed against the fixed contact shoes 2, 3 by a contact spring 7 formed of a compressed coil spring, and inserted between the movable contact shoe 4 and the bottom of the molded case. Thus, the movable contact shoe 4 is contacted with the fixed contact shoes 2, 3 via movable and fixed contacts.

An opening-and-closing mechanism 8 is installed above the fixed contact shoe 2 in FIG. 7, and a tip of an opening-and-closing lever 10 that is rotated around a rotating shaft 9 is located to oppose an upper surface of the movable contact shoe holder 6. When an opening-and-closing handle 11 of the opening-and-closing mechanism 8 is operated in an ON state, the opening-and-closing lever 10 is rotated clockwise in FIG. 7 to depress the movable contact shoe holder 6 against the force of the contact spring 7. The movable contact shoe 4 is then opened from the fixed contact shoes 2, 3 to clear the conduction path.

A thermally operated electromagnetic overcurrent-tripping device 12, which is formed of a bi-metallic element and an electromagnet (not shown), is disposed on the fixed contact shoe 3. The overcurrent-tripping device 12 has one end connected to the fixed contact shoe 3 and the other end connected to a load-side terminal 13 so as to unlock the opening-and-closing mechanism 8 by means of the bi-metallic element, which is bent when an overloading current flows through the conduction path, or by instantaneously attracting the movable iron core of the electromagnet if a heavy current such as a short-circuit current flows through the conduction path, whereby a stored force of an opening-and-closing spring (not shown) rotates the opening-and-closing lever 10 to open the movable contact shoe 4.

In this case, particularly in the presence of a heavy current, the movable iron core drives the movable contact shoe holder 6 downward to open the movable contact shoe 4 before the tripping operation of the opening-and-closing mechanism 8. When the current is shut off to eliminate the attractive force on the movable iron core, the movable contact shoe 4 attempts to rise under the force of the contact spring 7. However, since the rotation of the opening-and-closing lever 10 has been completed, the movable contact shoe 4 is held open. Furthermore, an arc occurs between the movable contact and the fixed contact when a heavy current is interrupted. This arc is guided into arc extinguishing chambers 14 and 15 installed below the fixed contact shoes 2 and 3, where it is extinguished. In order to transfer the current from the movable contact shoe 4, a commutation plate 16 is installed to extend across the arc extinguishing chambers 14, 15.

An example of the above overcurrent-tripping device 12 is described in Japanese Patent Application Laid-Open No. 6-52782. FIG. 8 shows a modified version of this patent. In this figure, the overcurrent-tripping device 12 is formed of a bi-metallic element 17 and an electromagnet 18. The bi-metallic element 17 has a heater 19 wound around it, and the electromagnet 18 comprises a movable iron core 21 inside an electromagnet coil 20. The heater 19 has one end connected to a fixed contact shoe (not shown) and the other end connected to the upper end 17*a* of the bi-metallic element 17. On the other hand, the bi-metallic element 17 is supported by a bi-metallic element support 22 at its lower end and is electrically connected to the bi-metallic element support 22.

In addition, although not seen in FIG. 8, the bi-metallic element support 22 is connected to a lower end of the electromagnet coil 20, which has an upper end 20*a* connected to a terminal 23. The electromagnet coil 20 is supported by a coil support 24. The coil support 24 has a lever 25 to enable rotation around a shaft 26, and a tip portion 25*a* of the lever 25 extends in a direction crossing the bi-metallic element support 22. The other end of the lever 25, which is not shown in FIG. 8, is connected to a lower end of a movable iron core 21. Although not shown, a fixed iron core is joined to a surface of the terminal 23, which is opposed to an upper-end surface of the movable iron core 21, and the movable iron core 21 is forced downward by means of a return spring interposed between the fixed iron core and the movable iron core 21.

A conduction path in this overcurrent-tripping device 12 comprises the heater 19, the bi-metallic element 17, the bi-metallic element support 22, the electromagnet coil 20, and the terminal 23, in that order. When a heavy current such as a short-circuit current flows through this conduction path, the movable iron core 21 is attracted upward toward the fixed iron core, while rotating the lever 25 in the direction of the arrow in the figure. In response to this operation, an opening-and-closing mechanism (not shown) will be tripped to open the movable contact shoe, but before this tripping action, the lever 25 pushes a movable contact shoe holder (not shown) downward to open the movable contact shoe. After the current has been shut off to eliminate any attractive force on the movable iron core, the movable contact shoe is maintained in the opened state by means of the opening-and-closing mechanism, which has performed the tripping operation.

The above conventional overcurrent-tripping device 12 has the following problems:

(1) The movable iron core 21 is attracted to the fixed iron core to rotate the lever 25 in order to push the movable contact shoe holder downward and open the movable contact shoe. Mechanical slack, however, inevitably occurs in a connection between the movable iron core 21 and the lever 25, and in a rotation-support-point portion of the lever 25, so that a time delay occurs between the linear movement of the movable iron core 21 and the rotational movement of the lever 25, resulting in a corresponding increase in operating time.

(2) Since the tip portion 25*a* of the lever 25 is located adjacent to the bi-metallic element 17, the increase in the thickness of the heater 19 for augmentation of its rating is limited.

(3) Although the lever 25 is used to push the movable contact shoe holder downward to open the movable contact shoe, the movable contact shoe holder's large mass makes it difficult to increase the opening speed of the movable contact shoe by an appropriate degree.

It is thus an object of the present invention to solve these problems in order to improve the shutting-off performance of the circuit breaker while facilitating rating augmentation.

SUMMARY OF THE INVENTION

In order to attain the above object, the present invention provides a circuit breaker, which comprises a pair of opposed fixed contact shoes, a holder formed of an insulating material and guided in a case to move linearly, a movable contact shoe held at the holder for linear movement and pressed by a contact spring toward the fixed contact shoes, an opening-and-closing mechanism for opening and closing the movable contact shoe, and an overcurrent-tripping device using a bi-metallic element and an electromagnet to detect an overcurrent flowing through a conduction path comprising the fixed and movable contact shoes, and for allowing the opening-and-closing mechanism to perform a tripping operation to open the movable contact shoe. The overcurrent-tripping device includes a movable iron core for the electromagnet to drive the movable contact shoe in an opening direction before the tripping operation of the opening-and-closing mechanism, the movable iron core being attracted when a short-circuit current flows through the conduction path.

In the above circuit breaker, the overcurrent-tripping device has a push rod penetrating the holder for linear movement so as to contact with the movable contact shoe. The electromagnet of the overcurrent-tripping device is located above the push rod so as to linearly attract the movable iron core in a moving direction of the push rod. When a short-circuit current flows through the conduction path, the movable iron core is attracted to drive the movable contact shoe via the push rod in the opening direction.

In the invention, since the linear movement of the movable iron core is transmitted to the movable contact shoe via the push rod without changing the direction of the movement, time delay associated with motional conversion does not occur. In addition, the movable contact shoe is driven by the push rod penetrating the movable contact shoe holder without the use of the movable contact shoe holder, so that after the movable iron core has been attracted, the movable contact shoe can be opened earlier and faster. On the other hand, since the electromagnet of the overcurrent-tripping device is located above the push rod penetrating the movable contact shoe holder, the bi-metallic element can be separated from the electromagnet to prevent the thickness of the heater wound around the bi-metallic element from being limited.

DETAILED DESCRIPTION OF PREFERRED EMBODIMENTS

Figure 1:
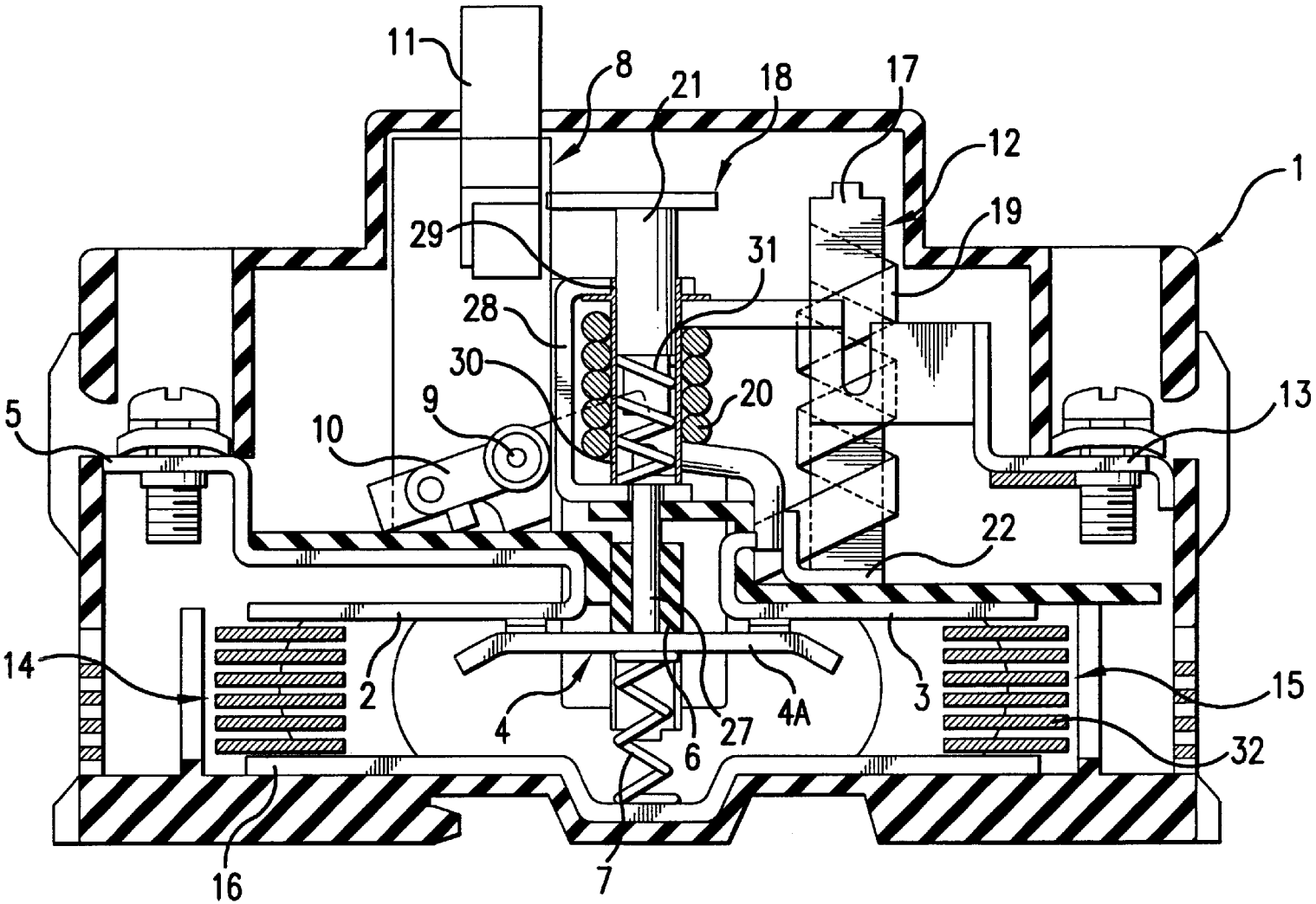
FIG. 1 is a vertical sectional view in an ON state of a circuit breaker showing an embodiment of the present invention.

Embodiments of the present invention will be described below with reference to FIGS. 1 to 6. The portions corresponding to the conventional example carry the same reference numerals, and no description is provided for these components that are substantially similar to the corresponding ones in the conventional example. FIG. 1 is a vertical sectional view showing an ON state of a three-pole circuit breaker. In this figure, a molded case 1 has pairs of fixed contact shoes 2 and 3 fixed in a middle stage thereof in parallel for three poles. Below each bottom surface of each pair of the fixed contact shoes 2 and 3, a movable contact shoe 4 for bridging the fixed contact shoes 2 and 3 is pressed by a contact spring 7 formed of a compressed coil spring. The fixed contact shoes 2, 3 and the movable contact shoe 4 have fixed contacts and movable contacts, respectively, fixed to their contact sections.

The molded case 1 has a load-side terminal 13 at an end, i.e. at the right side of the figure. The terminal 13 is connected to the fixed contact shoe 3 via the overcurrent-tripping device 12, as described below. The molded case 1 also has a power supply-side terminal 5 integrated with the fixed contact shoe 2 at its left end. The movable contact shoe 4 is guided and held for vertical linear movement by means of a movable contact shoe holder 6 integrally formed for three poles and made of an insulating material or resin. A push rod 27 penetrates the movable contact shoe holder 6 for a vertical linear movement, and a tip of the push rod 27 abuts against an upper surface of the movable contact shoe 4.

Figure 4:
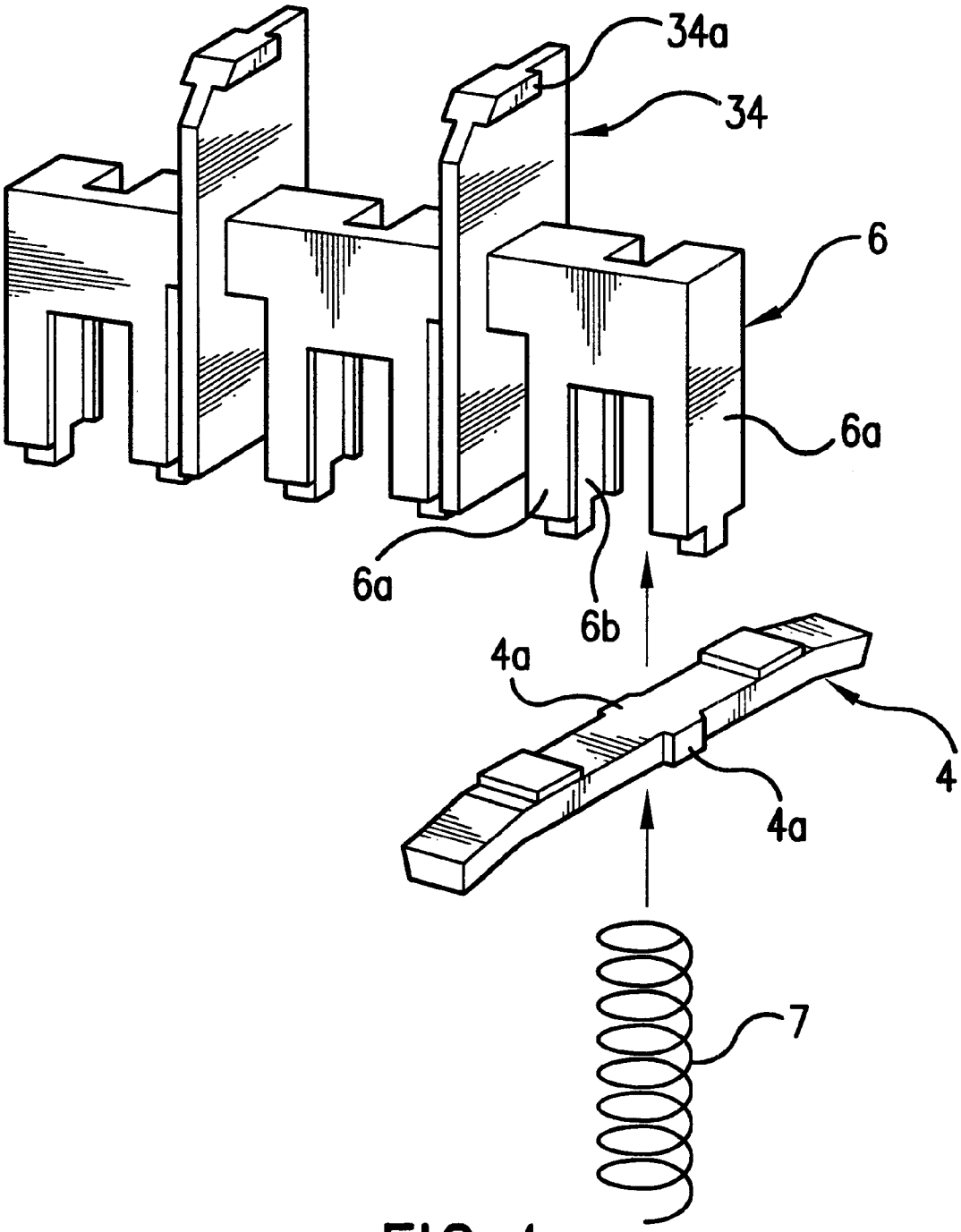
FIG. 4 is an exploded perspective view of a movable contact shoe holder section in FIG. 1.
Figure 5:
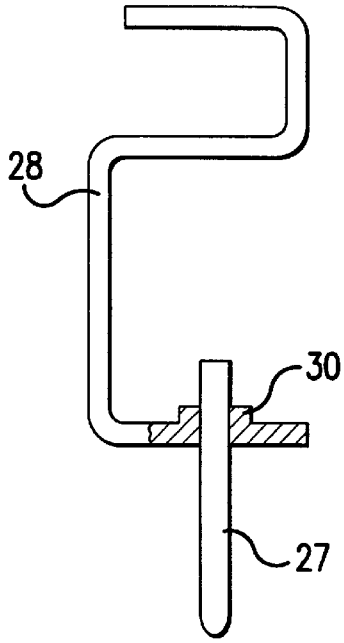
FIG. 5 is a side view of a yoke section of the electromagnet in FIG. 1 showing a part thereof in a sectional view.
Figure 6:
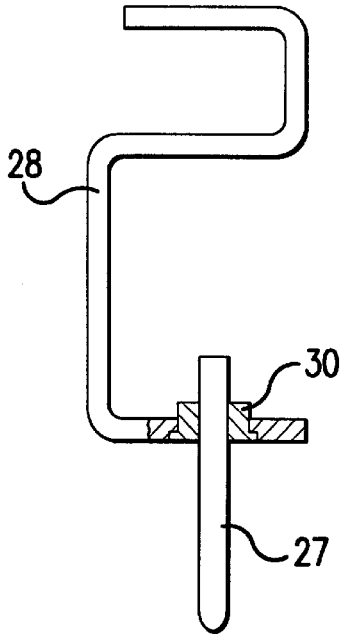
FIG. 6 is a side view of another embodiment of the yoke section of the electromagnet in FIG. 1 showing a part thereof in a sectional view.
Figure 7:
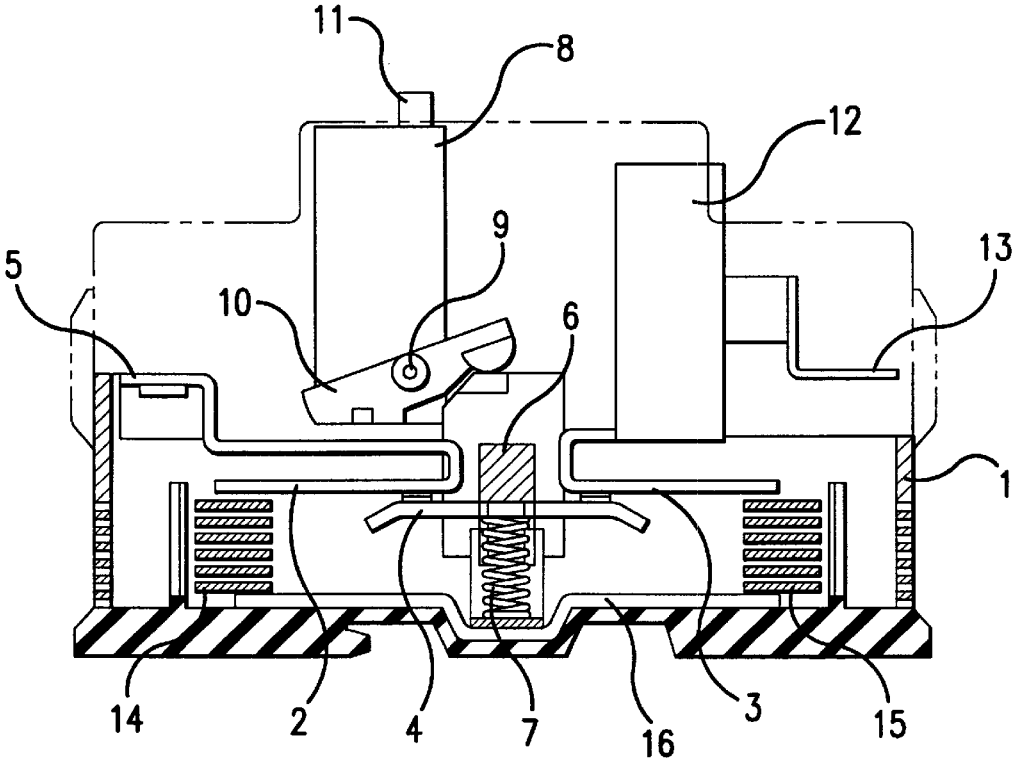
FIG.7 PRIOR ART
FIG. 7 is a vertical sectional view of a conventional circuit breaker.
Figure 8:
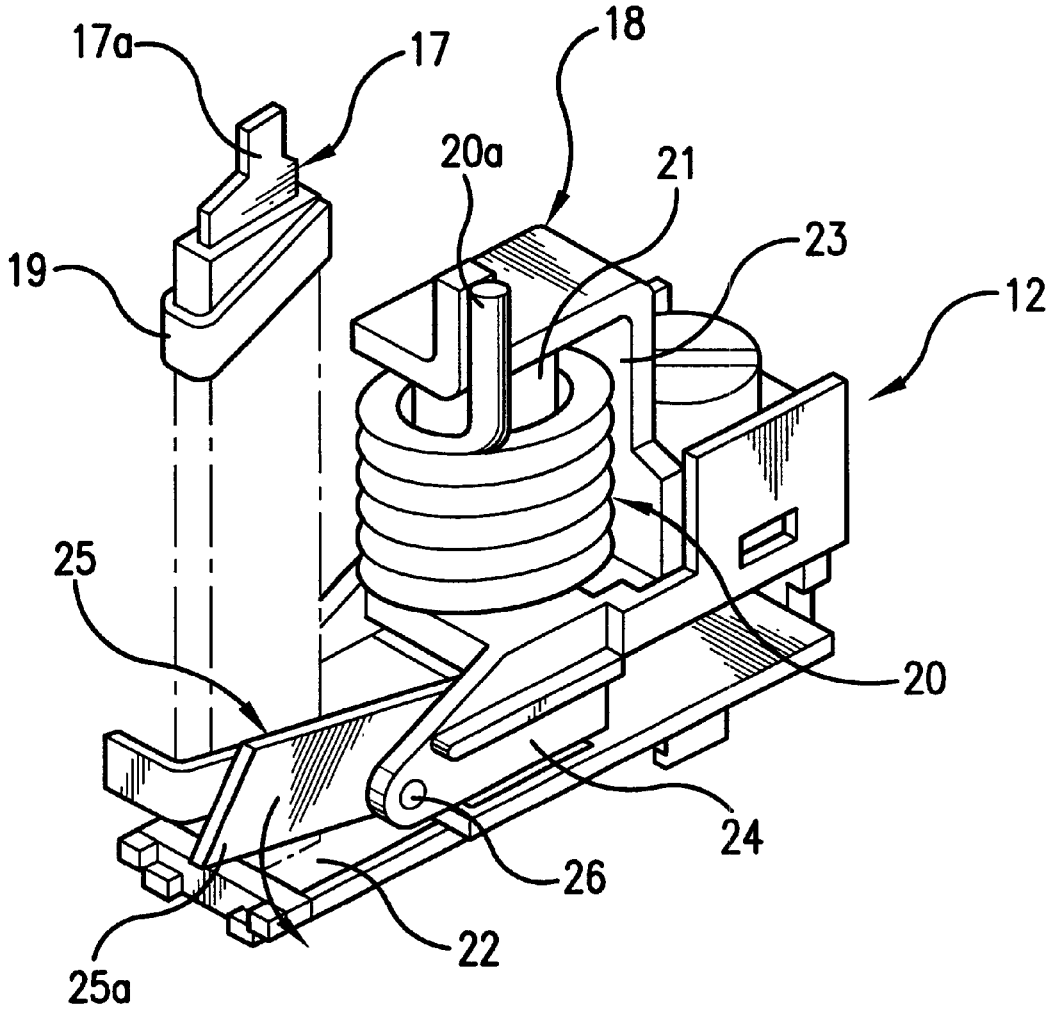
FIG.8 PRIOR ART
FIG. 8 is a perspective view of a conventional overcurrent-tripping device.

FIG. 4 is an exploded perspective view of a movable contact shoe section. The movable contact shoe section for each pole is formed of the gateway-shaped movable contact shoe holder 6 having a pair of leg sections 6*a* arranged laterally, the movable contact shoe 4, and the contact spring 7. The movable contact shoe holders 6 for the respective poles, which are molded by resin, are connected together so as to be integrated as a three-pole structure, with a barrier 34 provided between the poles. At each of the opposed inner side surfaces of the leg sections 6*a*, grooves 6*b* with low rising portions at its longitudinal edges are formed. On the other hand, the movable contact shoe 4 has projections 4*a* formed on opposite sides at its middle portion, so that when the movable contact shoe 4 is inserted between the leg sections 6*a* of the movable contact shoe holder 6, the projections 4*a* fit loosely in the corresponding grooves 6*b* so as to be locked in a longitudinal direction of the device while being held for a vertical linear movement. The barrier 34 has a thick operation section 34*a* formed at its top, so that the movable contact shoe holder 6 can be pushed and operated via the operation section 34*a* of the barrier 34 by means of a forked opening-and-closing lever 10 located in the central pole section (FIG. 1).

Referring back to FIG. 1, the overcurrent-tripping device 12 comprises a rectangular bi-metallic element 17 cantilevered in a vertical direction of the device by means of a bi-metallic element support 22, a lower end of which is formed of a conductive plate. A heater 19 is wound around the bi-metallic element 17 and is formed of a band material that has its lower end joined to the fixed contact shoe 3 and an upper end joined to the bi-metallic element 17. In addition, the overcurrent-tripping device 12 comprises an electromagnet 18 located above the push rod 27, an electromagnet coil 20 accommodated inside a U-shaped yoke 28 and wound around a hollow cylindrical bobbin 29, a staged cylindrical movable iron core 21 slidably situated inside the bobbin 29 opposite to a fixed iron core 30 integrated with the yoke 28 (see FIG. 5) or joined thereto (see FIG. 6), and a return spring 31 interposed between the fixed iron core 30 and the movable iron core 21 and formed of a compressed coil spring. In addition, the push rod 27 penetrates the yoke 28 and the fixed iron core 30 so as to be opposed to the movable iron core 21. When the electromagnet coil 20 is excited, the movable iron core 21 is attracted toward the fixed iron core 30 in a moving direction of the push rod 27.

At the front and rear portions of the movable contact shoe 4, arc extinguishing chambers 14 and 15 are located, respectively, and each of the extinguishing chambers 14 and 15 contains a plurality of magnetized plates 32 laminated at intervals. Also, at the bottom of the molded case 1, a commutation plate 16 formed of a conductive band material is arranged in such a manner as to extend across the extinguishing chambers 14, 15. The movable contact shoe 4 is driven for opening or closing, and for opening or separating when the opening-and-closing mechanism 8 performs an opening or closing operation and a tripping operation, respectively. Although the internal configuration of the opening-and-closing mechanism 8 is not shown, the opening-and-closing mechanism 8 has an opening-and-closing lever 10 that is rotated around a rotating shaft 9 when an opening-and-closing handle 11 is opened or closed. When the opening-and-closing mechanism 8 is unlocked via a link mechanism (not shown) due to an operation of the overcurrent-tripping device 12, energy stored in a main spring (not shown) is released to rotate the opening-and-closing lever 10 in the clockwise direction.

Figure 2:
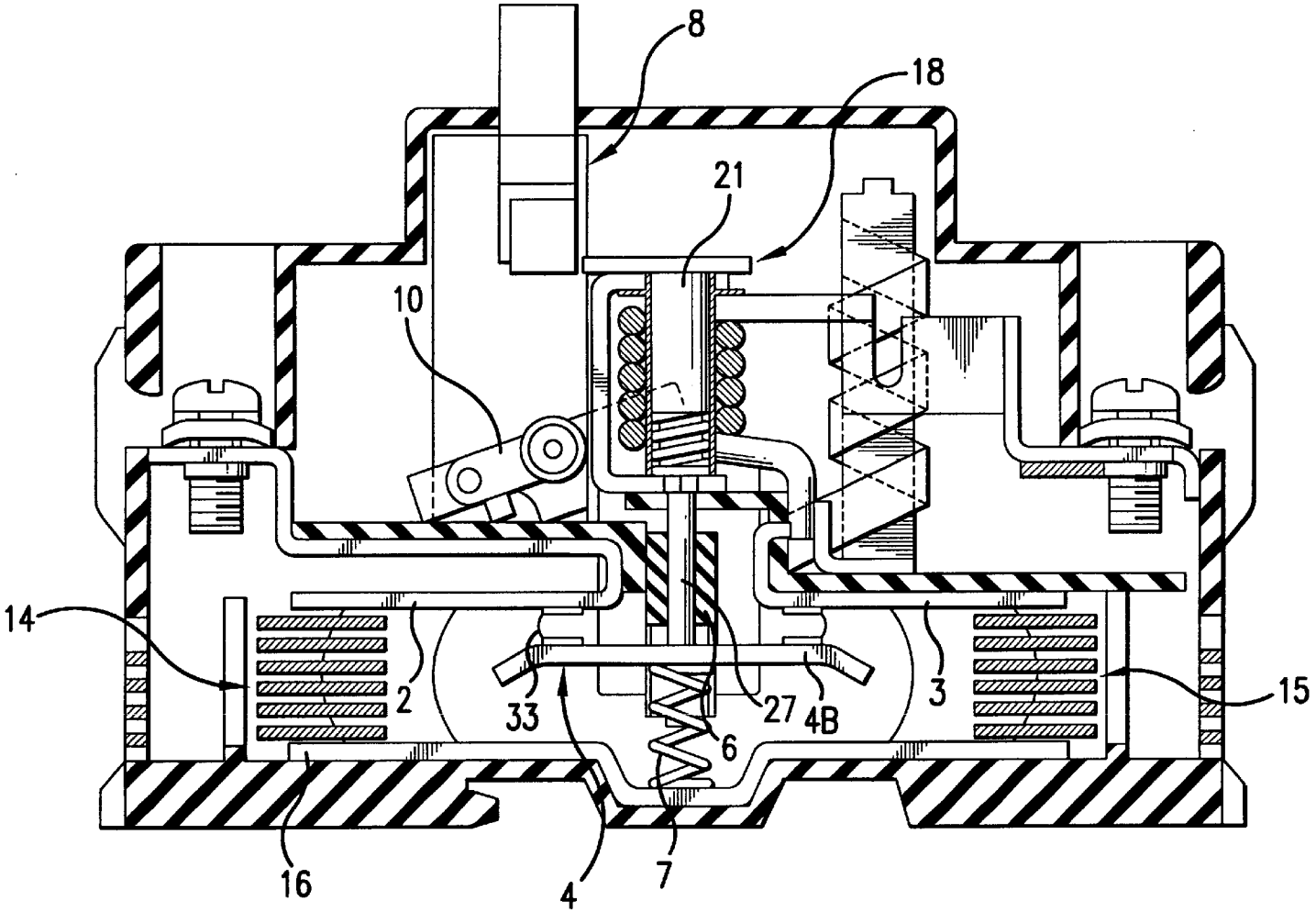
FIG. 2 shows the state of the circuit breaker in FIG. 1 in which an electromagnet of an overcurrent-tripping device has been activated.

In such a circuit breaker, in the ON state shown in FIG. 1, the movable contact shoe 4 is located in a position 4A, and a current flows through a path comprising the power supply side terminal 5, the fixed contact shoe 2, the movable contact shoe 4, the fixed contact shoe 3, the heater 19, the bi-metallic element 17, the bi-metallic element support 22, the electromagnet coil 20, and the load-side terminal 13, in this order. If a short-circuit current, e.g. several hundred amperes, flows through the path, the movable iron core 21 of the electromagnet 18 is attracted as shown in FIG. 2, and this movement is transmitted via the link mechanism (not shown) to the opening-and-closing mechanism 8, which is then unlocked to start a tripping operation. When the movable iron core 21 is attracted, the movable contact shoe 4 is simultaneously struck by the push rod 27 and driven to be opened and moved to a position 4B, which is shown in FIG. 2, before the opening operation associated with the tripping operation of the opening-and-closing mechanism 8 occurs. At this point, an arc 33 occurs between the fixed and movable contacts, whereby the electromagnet coil 20 is excited by a current flowing via the arc 33. The movable contact shoe 4, which has been pushed by the movable iron core 21, remains in the position 4B.

Figure 3:
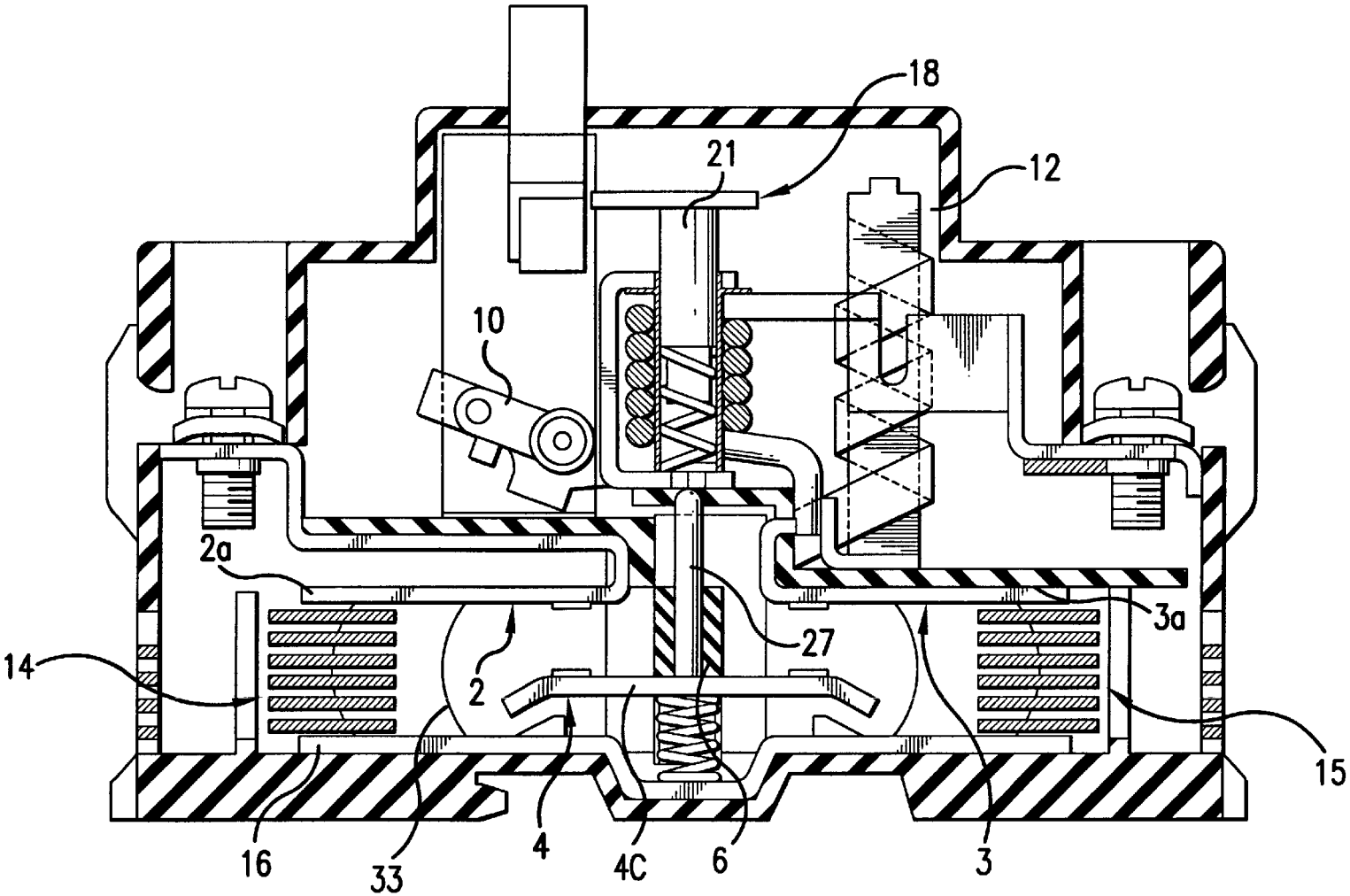
FIG. 3 shows the state of the circuit breaker in FIG. 2 in which an opening-and-closing mechanism has performed a tripping operation.

Subsequently, the opening-and-closing mechanism 8 performs a tripping operation to rotate the opening-and-closing lever 10 in the clockwise direction in order to push the movable contact shoe 4 downward from the position 4B in FIG. 2 to a position 4C in FIG. 3. The arc 33, which had been located between the fixed and movable contacts, then has its ends on the fixed contact sides moved to arc runners 2*a* and 3*a,* which are integrated with the fixed contact shoes 2 and 3, respectively, while having its ends on the movable contact sides moved onto the commutation plate 16, thereby transferring the short-circuit current from the movable contact shoe 4 to the commutation plate 16. Meanwhile, the arc 33 is extended and withdrawn into the arc extinguishing chambers 14, 15 by means of an electromagnetic force, where the arc 33 is drawn and cooled for rapid quenching. This completes the shutting-off of the current to eliminate the current flowing through the electromagnet coil 20, and the movable iron core 21 returns to a standby position due to the action of the return spring 31, as shown in FIG. 3. Furthermore, in the presence of an overload current of up to eight times the value of a rated current, the bi-metallic element 17 will be bent by heat generated by the heater 19, and this movement is transmitted via the link mechanism (not shown) to the opening-and-closing mechanism 8, which then starts the tripping operation to drive the movable contact shoe 4 so as to open and move it to a position 4C.

In the above embodiment, the movable iron core 21 transmits the linear movement to the movable contact shoe 4 via the push rod 27 without changing the direction of the motion, thereby preventing an operational delay caused by the conversion of the linear motion to the rotational motion. In addition, the movable iron core 21 directly drives the movable contact shoe 4 by means of the push rod 27 penetrating the movable contact shoe holder 6 without using the massive movable contact shoe holder 6, so that after the movable iron core 21 has been attracted, the movable contact shoe 21 can be opened earlier and faster. On the other hand, since the electromagnet 18 of the overcurrent-tripping device 12 is located above the push rod 27 penetrating the movable contact shoe holder 6, the bi-metallic element 17 is separated from the electromagnet 18, thereby removing limitations for the thickness of the heater 19 wound around the bi-metallic element 17. In the overcurrent-tripping device 12, the current path may comprise the fixed contact shoe 3, the electromagnet coil 20, the heater 19, the bi-metallic element 17, the bi-metallic element support 22, and the load-side terminal 13, in this order.

As described above, according to the present invention, the linear movement of the movable iron core is transmitted to the movable contact shoe without changing the direction of the motion, thereby preventing the operational delay arising from the motional conversion. In addition, since the push rod penetrating the movable contact shoe holder is used to drive the movable contact shoe without the use of the movable contact shoe holder, the motional mass is reduced to allow the movable contact shoe to be opened earlier and faster after the movable iron core has been attracted, thereby improving the shut-off performance. Further, since the electromagnet of the overcurrent-tripping device is located above the push rod penetrating the movable contact shoe holder, the bi-metallic element can be separated from the electromagnet, thereby removing limitations for the thickness of the heater wound around the bi-metallic element.

While the invention has been explained with reference to the specific embodiment of the invention, the explanation is illustrative and the invention is limited only by the appended claims.

What is claimed is:

1. A circuit breaker comprising:

a case, a pair of fixed contact shoes situated in the case, a movable contact shoe movably situated in the case, said movable contact shoe forming a conduction path together with the fixed contact shoes, a contact spring attached to the movable contact shoe to urge the movable contact shoe to the fixed contact shoes, an opening-and-closing mechanism attached to the movable contact shoe for opening and closing the movable contact shoe to control the circuit breaker, an overcurrent-tripping device for detecting an overcurrent flowing through the conduction path so that the opening-and-closing mechanism performs a tripping operation for opening the movable contact shoe, said overcurrent-tripping device having a yoke disposed above the movable contact shoe and having a hole therein, an electromagnet disposed on the yoke above the movable contact shoe to surround the hole and operated when a short-circuit current flows through the conduction path, a movable iron core situated in the electromagnet and located above the movable contact shoe, said movable iron core being attracted by the electromagnet when the short-circuit current flows through the conduction path and moved linearly toward the movable contact shoe, and a spring situated inside the electromagnet to urge the movable iron core located in the electromagnet in a direction away from the movable contact shoe, and a push rod situated between the movable iron core and the movable contact shoe and arranged linearly with respect to the movable iron core, said push rod passing through the hole and slidably disposed in the electromagnet so that when the short-circuit current flows through the conduction path, the movable iron core is attracted by the electromagnet linearly downwardly along a moving direction of the push rod by overcoming an elastic force of the spring and pushes the push rod to separate the movable contact shoe from the fixed contact shoe, to thereby immediately and directly drive the movable contact shoe in an opening direction.

2. A circuit breaker according to claim 1, further comprising a holder for holding the movable contact shoe, said holder being formed of an insulating material and situated in the case to be movable linearly in the case, said push rod penetrating the holder so as to directly contact the movable contact shoe.

3. A circuit breaker according to claim 2, wherein said overcurrent-tripping device includes a bi-metallic element for tripping the movable contact shoe through the opening-and-closing mechanism.

4. A circuit breaker according to claim 3, wherein said bi-metal element is located on one of the two fixed contact shoes, and the electromagnet is located above between the two fixed contact shoes.

5. A circuit breaker according to claim 4, wherein said overcurrent-tripping device further includes a spring situated inside the electromagnet to urge the movable iron core in a direction away from the movable contact shoe.

6. A circuit breaker according to claim 1, wherein said overcurrent-tripping device further includes a bi-metal element disposed on one of the fixed contact shoes, and a heater wound around the bi-metal element, said bi-metal element and heater being actuated by an overloading current flowing through the conduction path to actuate the opening-and-closing mechanism.

* * * * *